US008362996B2

(12) United States Patent
Huang et al.

(10) Patent No.: US 8,362,996 B2
(45) **Date of Patent: *Jan. 29, 2013**

(54) DISPLAY WITH CLK PHASE AUTO-ADJUSTING MECHANISM AND METHOD OF DRIVING SAME

(75) Inventors: Chien-Fu Huang, Taiwan (TW); Chun-Fan Chung, Taiwan (TW)

(73) Assignee: AU Optronics Corporation, Hsinchu (TW)

( * ) Notice: Subject to any disclaimer, the term of this patent is extended or adjusted under 35 U.S.C. 154(b) by 442 days.

This patent is subject to a terminal disclaimer.

(21) Appl. No.: 12/704,658

(22) Filed: Feb. 12, 2010

(65) Prior Publication Data

US 2011/0199368 A1 Aug. 18, 2011

(51) Int. Cl.
*G09G 3/36* (2006.01)

(52) U.S. Cl. ..... 345/99; 345/213

(58) Field of Classification Search ..... 345/98–100, 345/213

See application file for complete search history.

(56) References Cited

U.S. PATENT DOCUMENTS

| | | | |
|---|---|---|---|
| 6,125,157 | A | 9/2000 | Donnelly et al. |
| 6,873,318 | B1 | 3/2005 | Wong |
| 6,933,937 | B2 | 8/2005 | Agarwal et al. |
| 6,954,201 | B1 | 10/2005 | Ludden et al. |
| 7,349,510 | B2 | 3/2008 | Best et al. |
| 2001/0013802 | A1 | 8/2001 | Faulcon et al. |
| 2007/0211010 | A1 | 9/2007 | Lin |
| 2008/0106510 | A1 | 5/2008 | Yin |
| 2009/0303217 | A1 | 12/2009 | Chen et al. |
| 2010/0060557 | A1 | 3/2010 | Hsu |

FOREIGN PATENT DOCUMENTS

| | | | |
|---|---|---|---|
| WO | 02057891 | A1 | 7/2002 |

*Primary Examiner* — Ricardo L Osorio
(74) *Attorney, Agent, or Firm* — Morris Manning & Martin LLP; Tim Tingkang Xia, Esq.

(57) ABSTRACT

One aspect of the present invention relates to a display for displaying data. In one embodiment, the display includes a timing controller (TCON) configured to provide a plurality of data signals to be displayed, at least one clock signal and a clock training code corresponding to the plurality of data signals; a plurality of source drivers, each source driver configured to receive one or more corresponding data signals, the at least one clock signal and the clock training code from the TCON, generate a plurality of clock signal according to the at least one clock signal, select one clock signal from the plurality of clock signals as an optimal clock signal according to the clock training code, and latch the one or more corresponding data signals according to the optimal clock signal; and a display panel configured to display the plurality of latched data received from the plurality of source drivers.

25 Claims, 18 Drawing Sheets

DISPLAY WITH CLK PHASE AUTO-ADJUSTING MECHANISM AND METHOD OF DRIVING SAME

FIELD OF THE INVENTION

The present invention relates generally to a display, and more particularly to a display that utilizes a CLK phase auto-adjusting mechanism in source drivers to increase the operation frequency of the display and a method of driving same.

BACKGROUND OF THE INVENTION

A typical driving system of a flat panel display includes a timing controller, source drivers and gate drivers. The timing controller generates data, clock and synchronization signals, which are transmitted to the source drivers in a bus manner. The source drivers receive data from the timing controller according to the rising and falling edges of the clock signal. Transmission interfaces commonly used for signal transfer between the timing controller and the source drivers are interfaces with two signal levels, such as reduced swing differential signaling (RSDS) and mini low voltage differential signaling (mini-LVDS) interfaces.

As the flat panel display moves toward a large panel size, a high resolution and a high frame rate, the data transmission rate in the driving system is substantially increased. Besides, in the flat panel display, transmission of data and clock signals employs the bus transmission interface. For a large panel size of the flat panel display, the signaling lines coupling to the timing controller and different source drivers have great line length difference. Accordingly, the signaling lines corresponding to different source drivers may work under different loads, resulting in rising and falling rates of transmission signals. Additionally, since the source drivers jointly receive the data signals via a bus, the data signals received by different source drivers may have different phase delays due to different transmission line lengths. As a result, data and clock skews may occur in the transmission signals, thereby resulting in erroneous data reception in the source drivers and therefore deteriorating the performance of the flat panel display.

Therefore, a heretofore unaddressed need exists in the art to address the aforementioned deficiencies and inadequacies.

SUMMARY OF THE INVENTION

The present invention, in one aspect, relates to a display for displaying data. In one embodiment, the display includes a timing controller (TCON) configured to provide a plurality of data signals to be displayed, at least one clock signal, CLK, and a clock training code corresponding to the plurality of data signals; a plurality of source drivers coupled with the timing controller, each source driver (SD) configured to receive one or more corresponding data signals, the at least one clock signal CLK and the clock training code from the timing controller, generate a plurality of clock signals, {CLKj}, according to the at least one clock signal CLK, wherein j=1, 2, 3, . . . , N, N being a positive integer, select one clock signal from the plurality of clock signals {CLKj} as an optimal clock signal according to the clock training code, and latch the one or more corresponding data signals according to the optimal clock signal; and a display panel coupled with the plurality of source drivers, and configured to display the plurality of latched data received from the plurality of source drivers.

In one embodiment, each source driver comprises a multi-phase clock generator for generating the plurality of clock signals, {CLKj}; and a clock selector for obtaining the optimal clock signal from the plurality of clock signals {CLKj} according to the clock training code. The multi-phase clock generator comprises buffer delays, delay locked loops (DLL) or phase locked loops (PLL). Each of the plurality of clock signals {CLKj} has a frequency that is identical to that of the at least one clock signal CLK and a phase that is different from each other and from that of the clock signals CLK The clock training code is transmitted from the timing controller to the plurality of source drivers during a blanking.

In one embodiment, the timing controller is configured to further provide a synchronization signal, SYNC, to the plurality of source drivers, wherein the synchronization signal SYNC has a high voltage period defining a clock training period in which the clock training code occurs. In another embodiment, the timing controller is configured to further provide a receiving setup signal, DIO, and/or an output setup signal, STB, used to define a clock training period in which the clock training code occurs.

In one embodiment, the clock signal is transmitted from the timing controller to the plurality of source drivers in a bus type, and wherein the plurality of data signals is transmitted from the timing controller to the plurality of source drivers in one of a bus type, a point-to-point type and a cascade type.

In one embodiment, the display may have a scrambler coupled with the timing controller for scrambling the plurality of data signals before it is provided to the plurality of source drivers; and a plurality of descramblers, each descramble coupled with a corresponding source driver for descrambling scrambled data signals received from the scrambler.

In another aspect, the present invention relates to a method for driving a display for data display. In one embodiment, the method includes the steps of (a) providing a plurality of data signals to be displayed, at least one clock signal, CLK, and a clock training code corresponding to the plurality of data signals; (b) generating a plurality of clock signals, {CLKj}, according to the at least one clock signal CLK, wherein j=1, 2, 3, . . . , N, N being a positive integer; (c) selecting one clock signal from the plurality of clock signals {CLKj} as an optimal clock signal according to the clock training code; and (d) latching the plurality of data signals according to the optimal clock signal. Each of the plurality of clock signals {CLKj} has a frequency that is identical to that of the at least one clock signal CLK and a phase that is different from each other and from that of the clock signals CLK In one embodiment, step (a) is performed with a timing controller, and wherein steps (b)-(d) are performed with a plurality of source drivers.

In one embodiment, the generating step is performed with a multi-phase clock generator, wherein the multi-phase clock generator comprises buffer delays, DLL or PLL. The selecting step is performed with a clock selector. In one embodiment, the selecting step comprises the steps of comparing each of the plurality of clock signals {CLKj} with the clock training code; determining whether a rising or falling edge of each of the plurality of clock signals {CLKj} falls within the clock training code; and selecting the one of which its rising edge or falling edge falls in the most middle of the clock training code as the optimal clock signal.

In one embodiment, the clock signal is transmitted from the timing controller to the plurality of source drivers in a bus type, and wherein the plurality of data signals is transmitted from the timing controller to the plurality of source drivers in one of a bus type, a point-to-point type and a cascade type.

The clock training code is transmitted from the timing controller to the plurality of source drivers during a blanking.

In one embodiment, the method may have the step of providing a synchronization signal, SYNC having a high voltage period defining a clock training period in which the clock training code occurs. In another embodiment, the method may have the step of providing a receiving setup signal, DIO, and/or an output setup signal, STB, used to define a clock training period in which the clock training code occurs.

Additionally, the method also includes the step of displaying the latched data signals. Moreover, the method may include steps of scrambling the plurality of data signals before the providing step is performed; and descrambling the scrambled data signals before the latching step is performed.

In yet another aspect, the present invention relates to a display for displaying data. In one embodiment, the display has means for providing a plurality of data signals to be displayed, at least one clock signal, CLK, and a clock training code corresponding to the plurality of data signals; means for generating a plurality of clock signals, {CLKj}, according to the at least one clock signal CLK, wherein j=1, 2, 3, . . . , N, N being a positive integer; means for selecting one clock signal from the plurality of clock signals {CLKj} as an optimal clock signal according to the clock training code; and means for latching the plurality of data signals according to the optimal clock signal; and means for displaying the latched data signals.

In one embodiment, the providing means comprises a timing controller. The generating means comprises a multi-phase clock generator, and wherein the selecting means comprises a clock selector. The multi-phase clock generator and the clock selector constitute a source driver.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
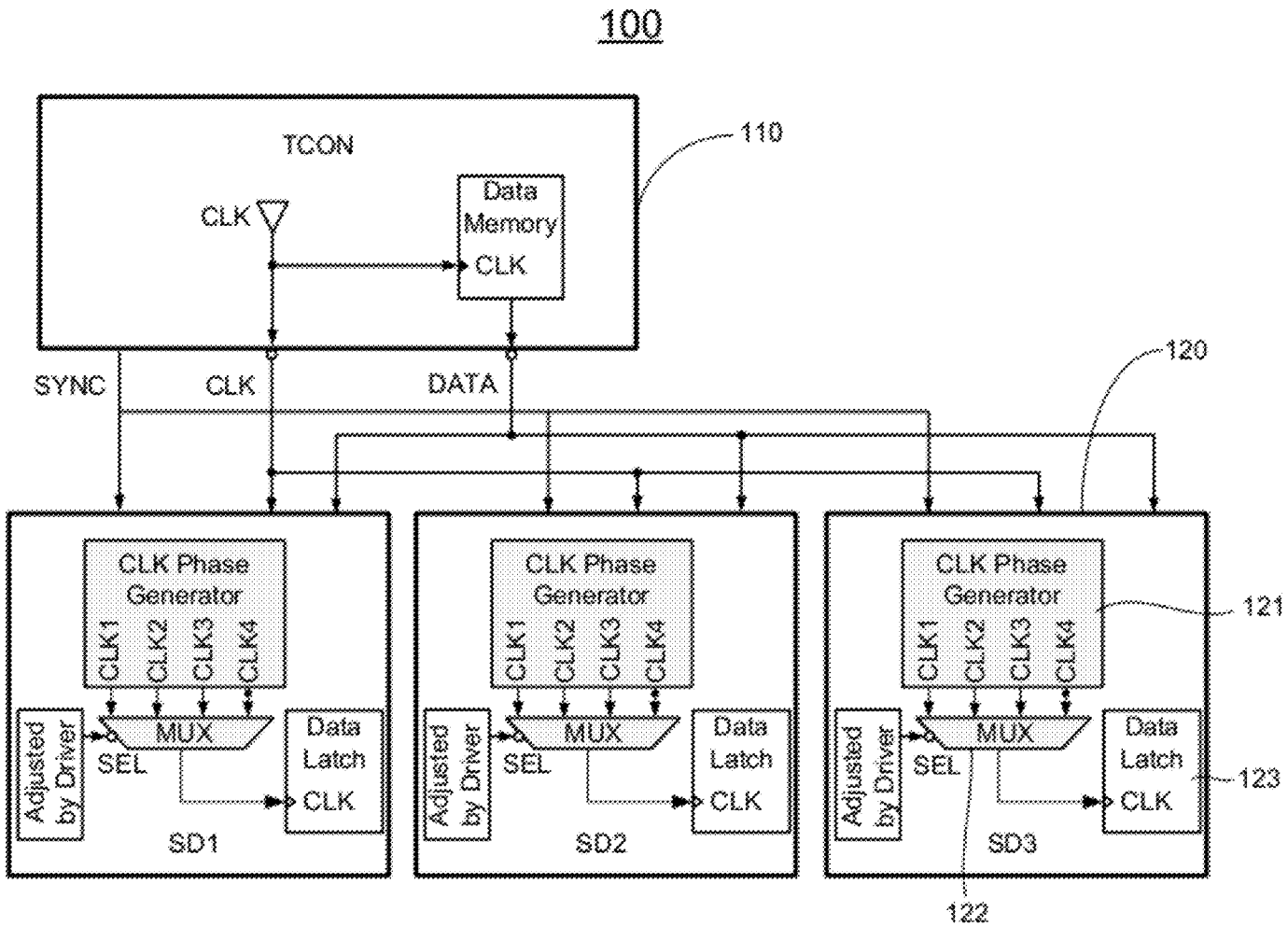
FIG. 1 shows schematically a partially block diagram of a display according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

The description will be made as to the embodiments of the present invention in conjunction with the accompanying drawings in FIGS. 1-18. In accordance with the purposes of this invention, as embodied and broadly described herein, this invention, in one aspect, relates to a display that utilizes a CLK phase auto-adjusting mechanism in source drivers to increase the operation frequency of the display and improve the performance of the display and a method of driving same.

Referring to FIG. 1, a partially block diagram of a display 100 is schematically shown according to one embodiment of the present invention. In this exemplary embodiment, the display 100 includes a timing controller (TCON) 110 and a plurality of source drivers 120 coupled with the timing controller 110. Generally, the timing controller 110 receives low voltage differential signals (LVDS) from one or more upstream devices and responsively generates clocks, control signals and data signals to be displayed. The generated clocks, control signals and data signals are transmitted to the source drivers 120 via one or more transmission interfaces. The source drivers 110 convert the received data signals into analog voltage driving signals in according to the clocks and control signals. The converted analog voltage driving signals is used to drive a display panel (not shown) for display of the data signals.

Specifically, in the embodiment, the timing controller 110 is configured to provide a plurality of data signals, DATA, to be displayed, at least one clock signal, CLK, a clock training code corresponding to the plurality of data signals DATA, and a synchronization signal, SYNC. The synchronization signal SYNC is adapted for controlling the time of outputting the voltage driving signals, i.e., the synchronization signal SYNC functions to notify each source driver 120 of the time the timing controller 110 transmits the data signals. In this embodiment, the synchronization signal SYNC is also adapted for initializing a process of clock phase selection, which its high voltage period is used to define a clock training period in which the clock training code occurs. The clock training code is transmitted from the timing controller 110 to the plurality of source drivers 120 during a blanking.

Each source driver (SD) 120 has a multi-phase clock generator 121 and a MUX (clock selector) 122 and a data latch unit 123. The multi-phase clock generator 121 includes buffer delays, delay locked loops (DLL) or phase locked loops (PLL).

The source driver 120 is configured to receive one or more corresponding data signals DATA, the at least one clock signal CLK and the clock training code from the timing controller 110. Responsively, the multi-phase clock generator 121 of the source driver 120 generates a plurality of clock signals, {CLKj}, according to the at least one clock signal CLK. In the embodiment, N=4. People skilled in the art would appreciate that other number of N can also be utilized to practice the present invention. Each of the plurality of clock signals {CLKj} has a frequency that is identical to that of the at least one clock signal CLK and a phase that is different from each other and from that of the clock signals CLK. The MUX 122 of the source driver 120 selects one clock signal from the plurality of clock signals {CLKj} as an optimal clock signal according to the clock training code. The selected optimal clock signal is used to latch the one or more corresponding data signals in the data latch unit 123. The latched data signals are adapted for driving the display panel to display the data signals.

In the embodiment, the synchronization signal SYNC, the at least one clock signal CLK and the data signals DATA are transmitted from the timing controller 110 to the source drivers 120 in the bus type manner. As shown below, they can be transmitted from the timing controller 110 to the source drivers 120 in other manners, such as in a cascade type and a point-to-point type.

Figure 2:
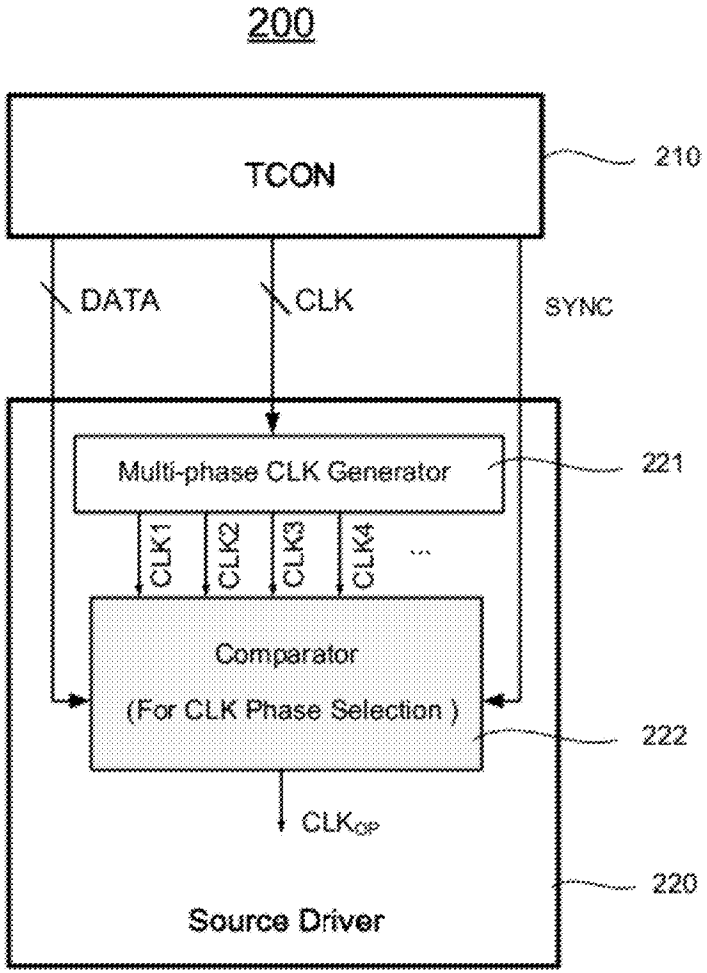
FIG. 2 shows schematically a partially block diagram of a display according to one embodiment of the present invention.

FIG. 2 shows schematically a partially block diagram of a display 200 according to one embodiment of the present invention. The display 200 includes a timing controller 210 and a source driver 220, which both are essentially same as those of the display 100 shown in FIG. 1. The source driver 220 has a multi-phase clock generator 221 for generating multiple phase clock signals, CLK1, CLK2, CLK3, . . . , and a clock phase comparator (clock phase selector) 222 for receiving the multiple phase clock signals, CLK1, CLK2, CLK3, . . . , from the multi-phase clock generator 221, and comparing each of them to a clock training code (or clock correction code) received from the timing controller 210, and selecting one clock of which its rising edge or falling edge falls in the most middle of the clock correction code as the optimal clock signal $CLK_{OP}$. The optimal clock signal $CLK_{OP}$ will be used to latch the data signal DATA received from the timing controller 210.

Figure 3:
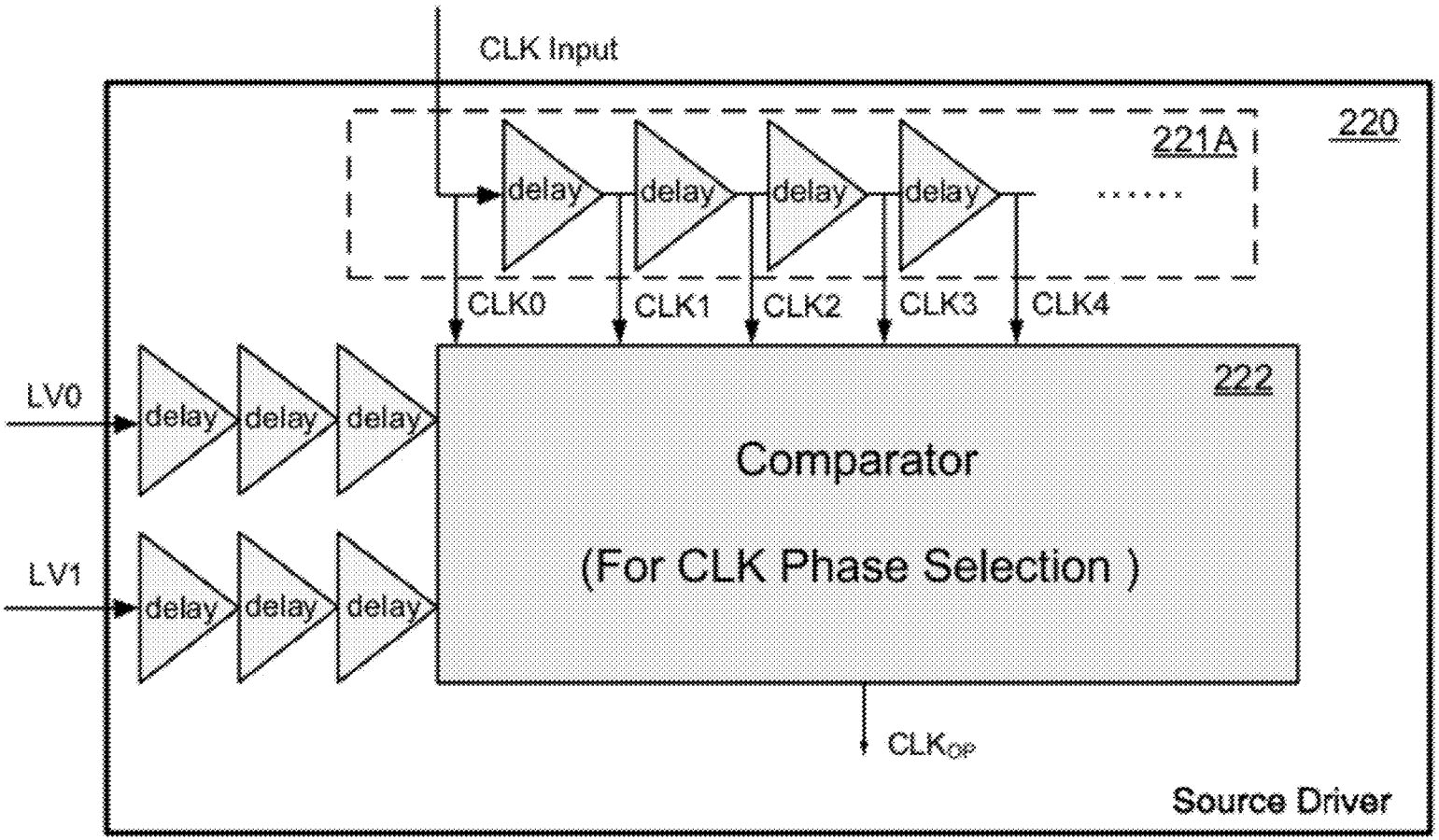
FIG. 3 shows schematically a block diagram of a multi-phase clock generator of a display according to one embodiment of the present invention.
Figure 4:
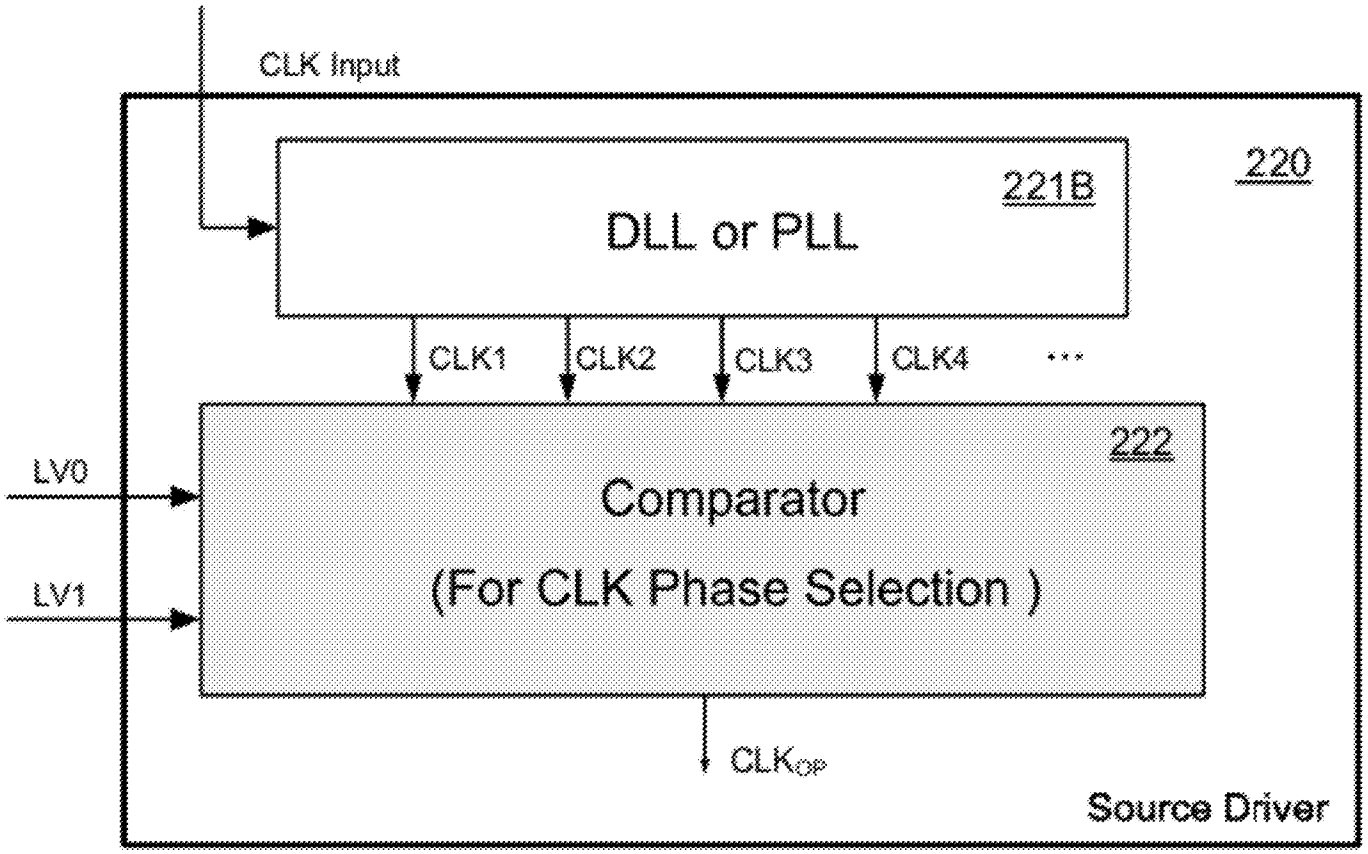
FIG. 4 shows schematically a block diagram of a multi-phase clock generator of a display according to another embodiment of the present invention.

FIGS. 3 and 4 are two embodiments of the source driver 220. In one embodiment as shown in FIG. 3, the multi-phase clock generator 221A of the source driver 220 includes buffer delays. In the other embodiment, the multi-phase clock generator 221B of the source driver 220 includes buffer delays, as shown in FIG. 4.

Figure 5:
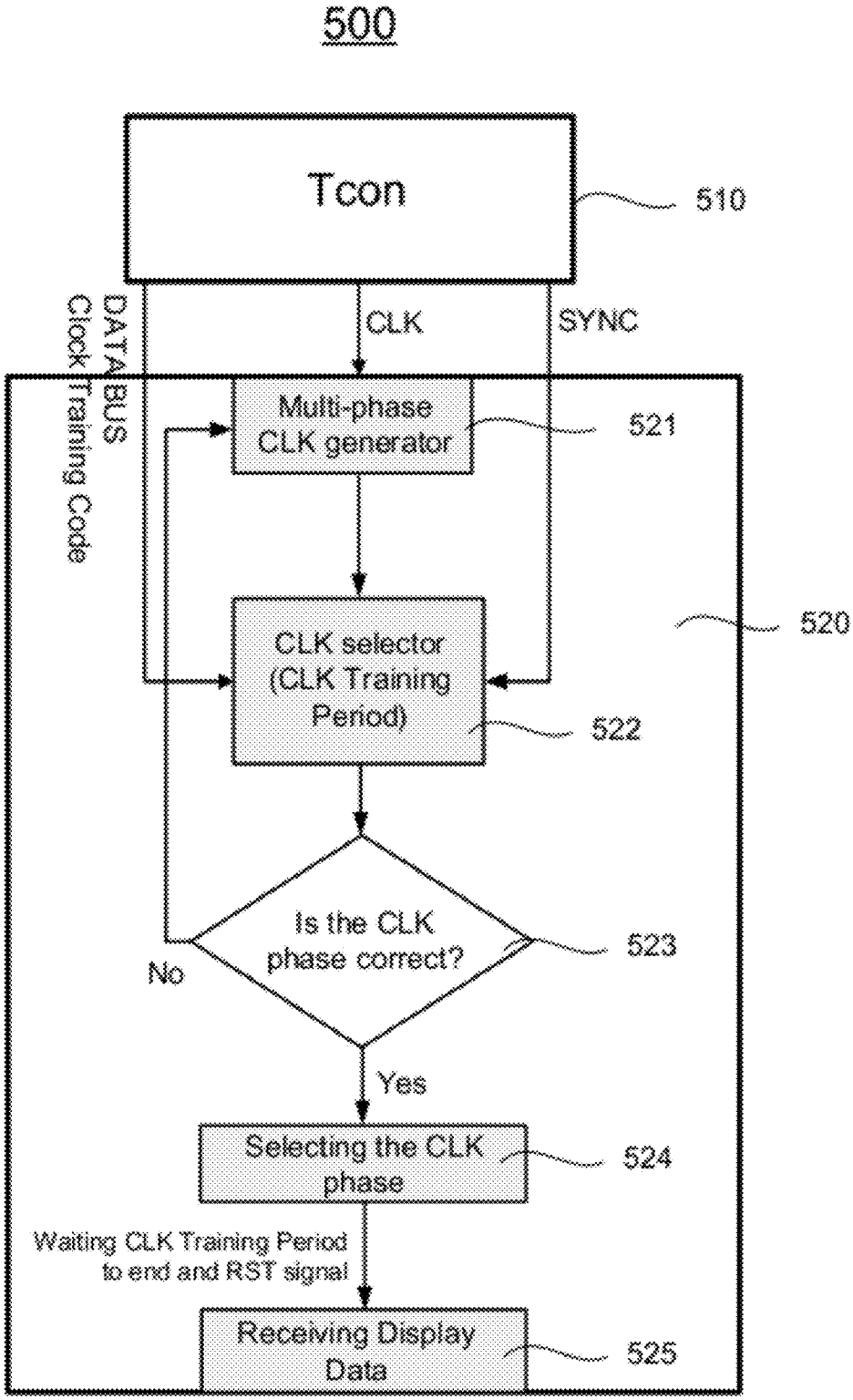
FIG. 5 shows schematically a flow chart for a clock phase selection according to one embodiment of the present invention.

Referring to FIGS. 5-8, and particularly to FIG. 5, a block diagram of a display 500 and its flow chart for a clock phase selection are schematically shown according to one embodiment of the present invention.

Figure 6:
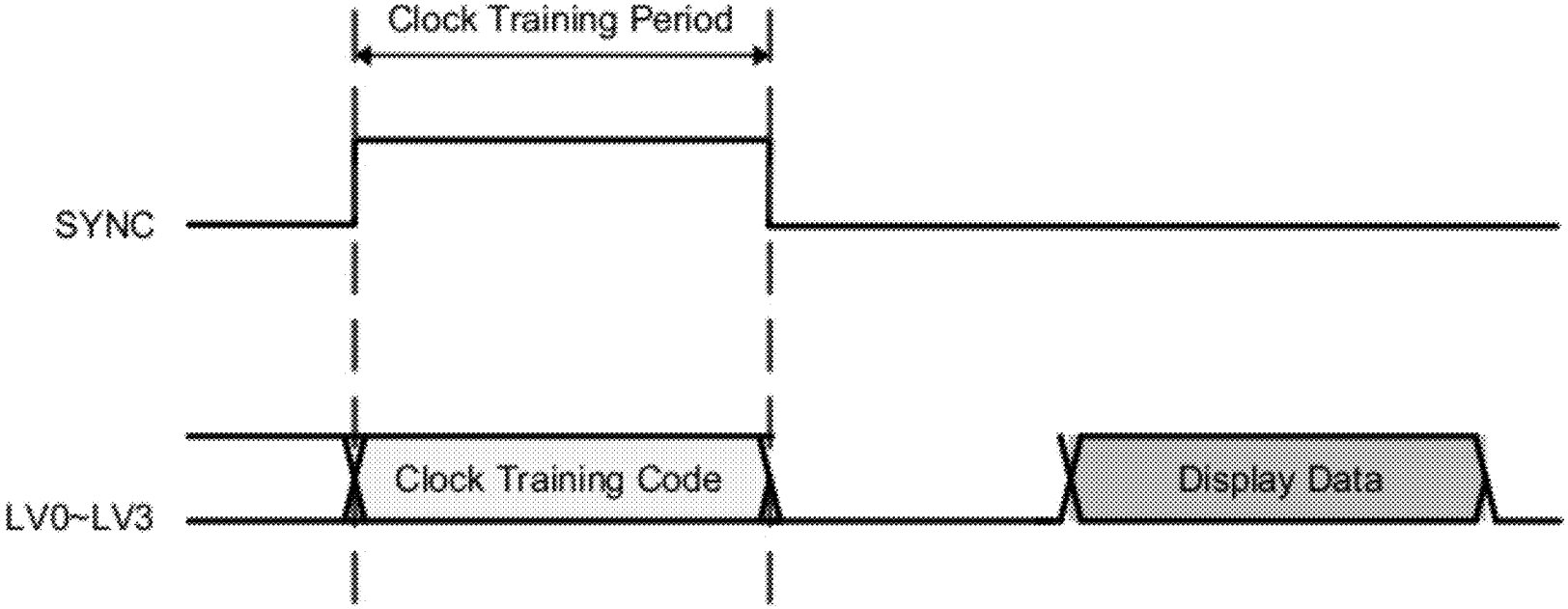
FIG. 6 shows schematically a timing chart of signals for driving a display according to one embodiment of the present invention.
Figure 7:
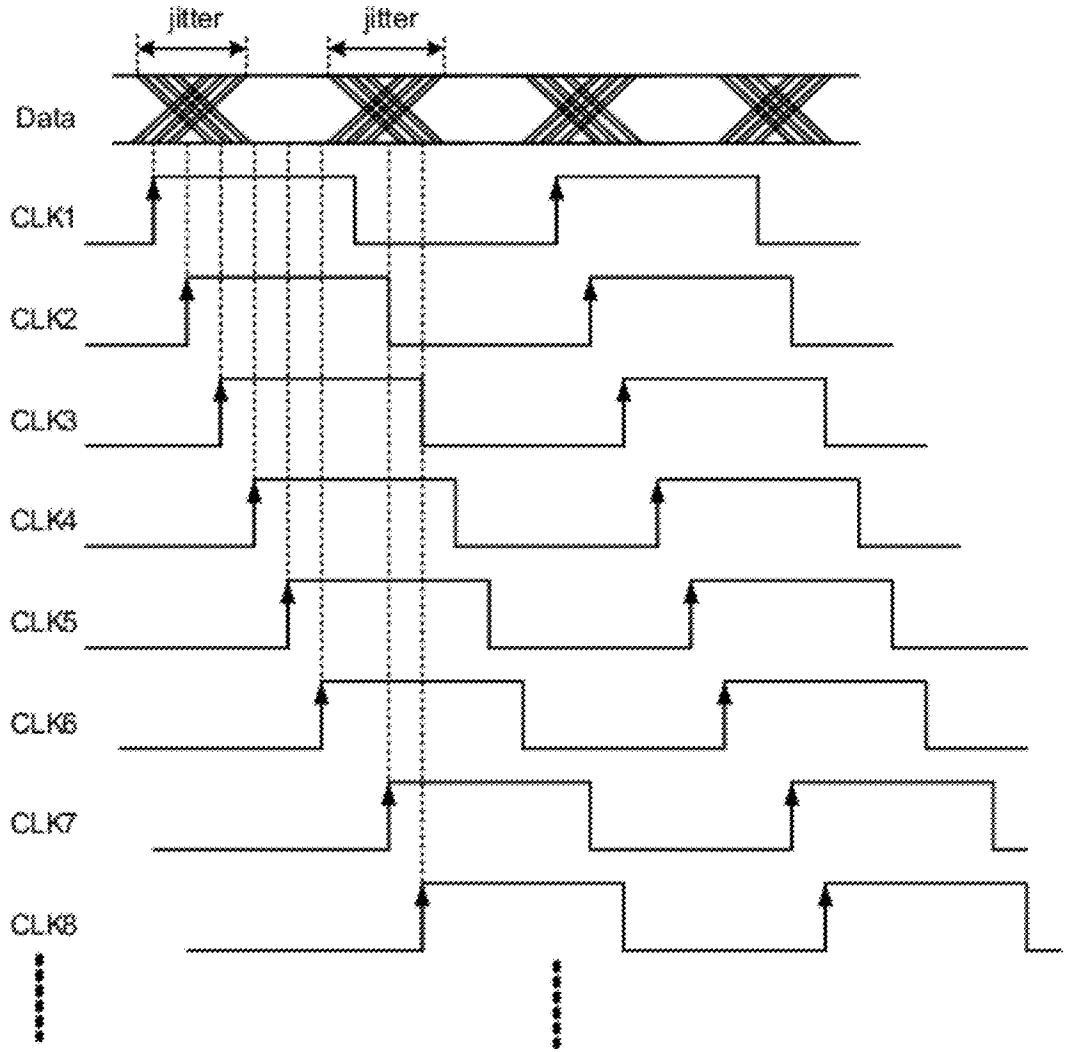
FIG. 7 shows schematically a timing chart of signals used for a clock phase selection according to one embodiment of the present invention.
Figure 8:
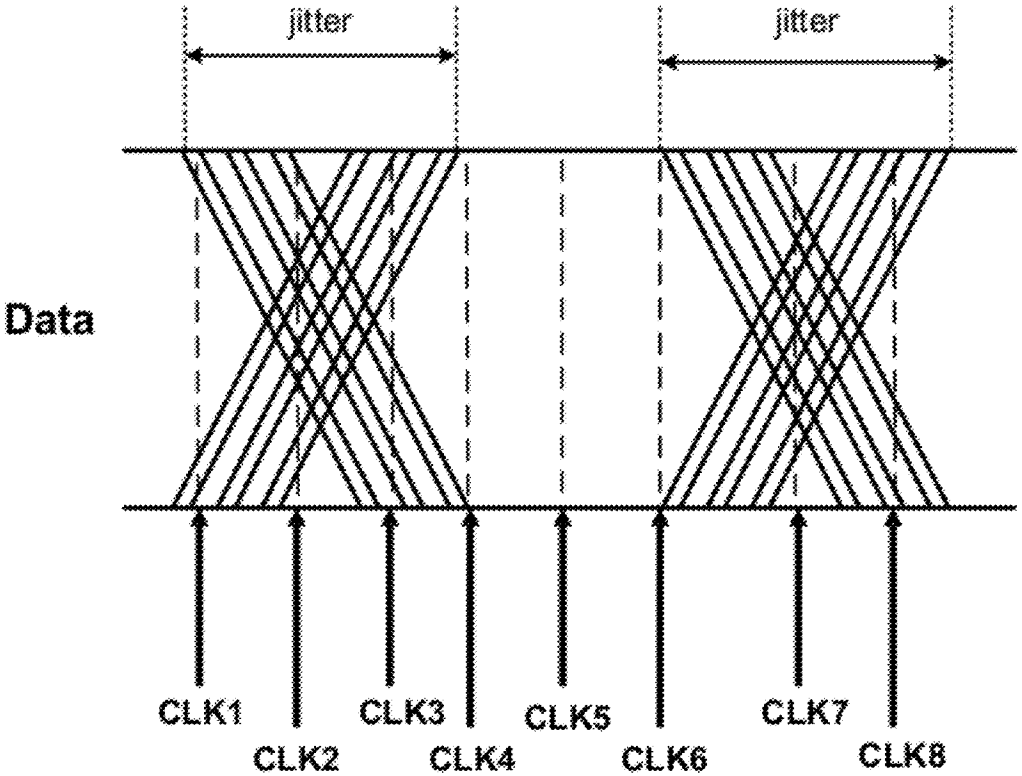
FIG. 8 shows schematically a clock phase selection shown in FIG. 7.

At first, the timing controller 510 generates data signals DATA, a clock signal CLK, a clock training code corresponding to the data signals DATA, and a synchronization signal SYNC, and transmits them to the source driver 520 via one or more transmission interfaces. When the at least one clock signal CLK is received by the multi-phase CLK generator 521, it generates multiple phase clock signals, CLK1, CLK2, CL3, . . . , responsively. The multiple phase clock signals, CLK1, CLK2, CL3, . . . , have the same frequency as that of the at least one clock signal CLK and different phases, as shown in FIGS. 7 and 8. The generated multiple phase clock signals, CLK1, CLK2, CL3, . . . , along the data signals DATA, the clock training code and the synchronization signal SYNC, are transmitted to the CLK selector 522 of the source driver 520. The synchronization signal SYNC has a high voltage period that is used to define a clock training period, as shown in FIG. 6. During the clock training period, the CLK selector 522 compares each of the generated multiple phase clock signals, CLK1, CLK2, CL3, . . . , with the clock training code at step 523. If it is found that there are one or more of the generated multiple phase clock signals of which their rising edges or falling edges fall in the clock training code, the one of which its rising edge or falling edge falls in the most middle of the clock training code is selected as the optimal clock signal $CLK_{OP}$ (at step 524).

For example, as shown in FIGS. 7 and 8, there are eight clock signals CLK1-CLK8 having different phases are generated. Of them, the rising edges of CLK1, CLK2, CLK3, CLK7 and CLK8 are corresponding to the jitter portion of the DATA, and the rising edges of CLK4, CLK5 and CLK6 fall into the clock training code that are defined between two neighboring data jitters. Further, the rising edge of CLK5 is in the most middle of the clock training code. Therefore, CLK5 is selected as the optimal clock signal $CLK_{OP}$.

Referring back to FIG. 5, after the clock training period ends and a RST signal starts, the display data is received at step 525. Otherwise, if no rising or falling edge of the generated multiple phase clock signals, CLK1, CLK2, CL3, . . . , falls in the clock training code, the multi-phase CLK generator 521 is requested to re-generate second multiple phase clock signals in accordance with the at least one clock signal CLK, which will be send to the CLK selector 522 for CLK phase selection.

Figure 9:
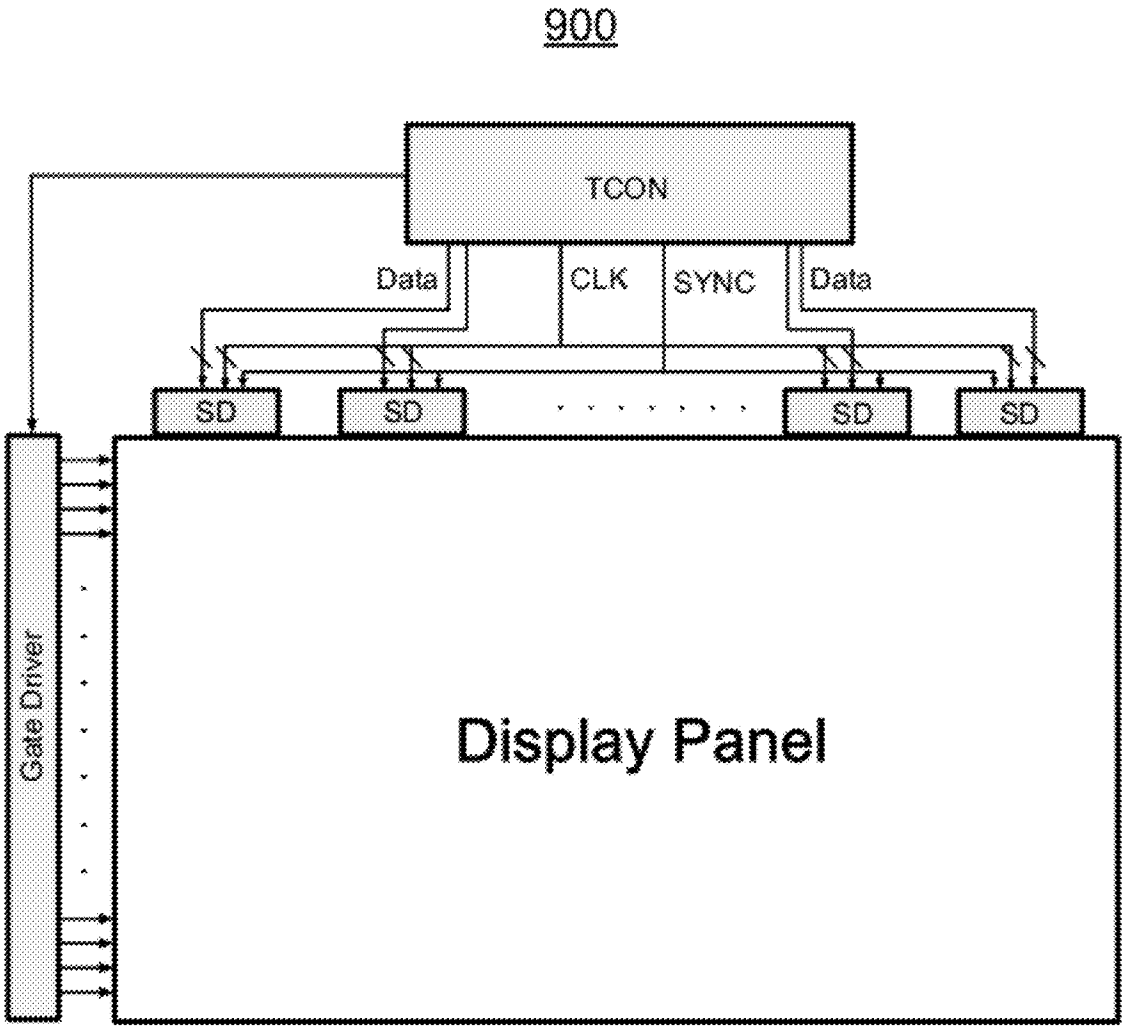
FIG. 9 shows schematically a block diagram of a display according to one embodiment of the present invention.
Figure 10:
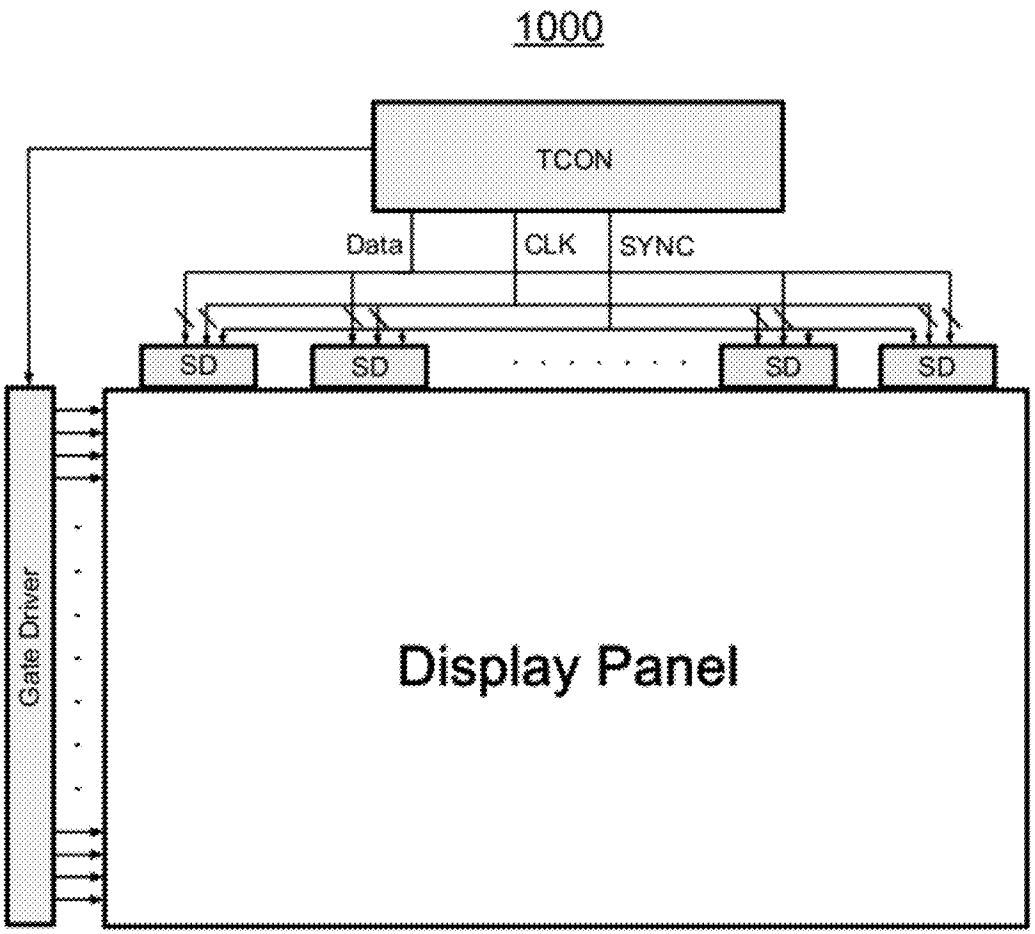
FIG. 10 shows schematically a block diagram of a display according to another embodiment of the present invention.
Figure 11:
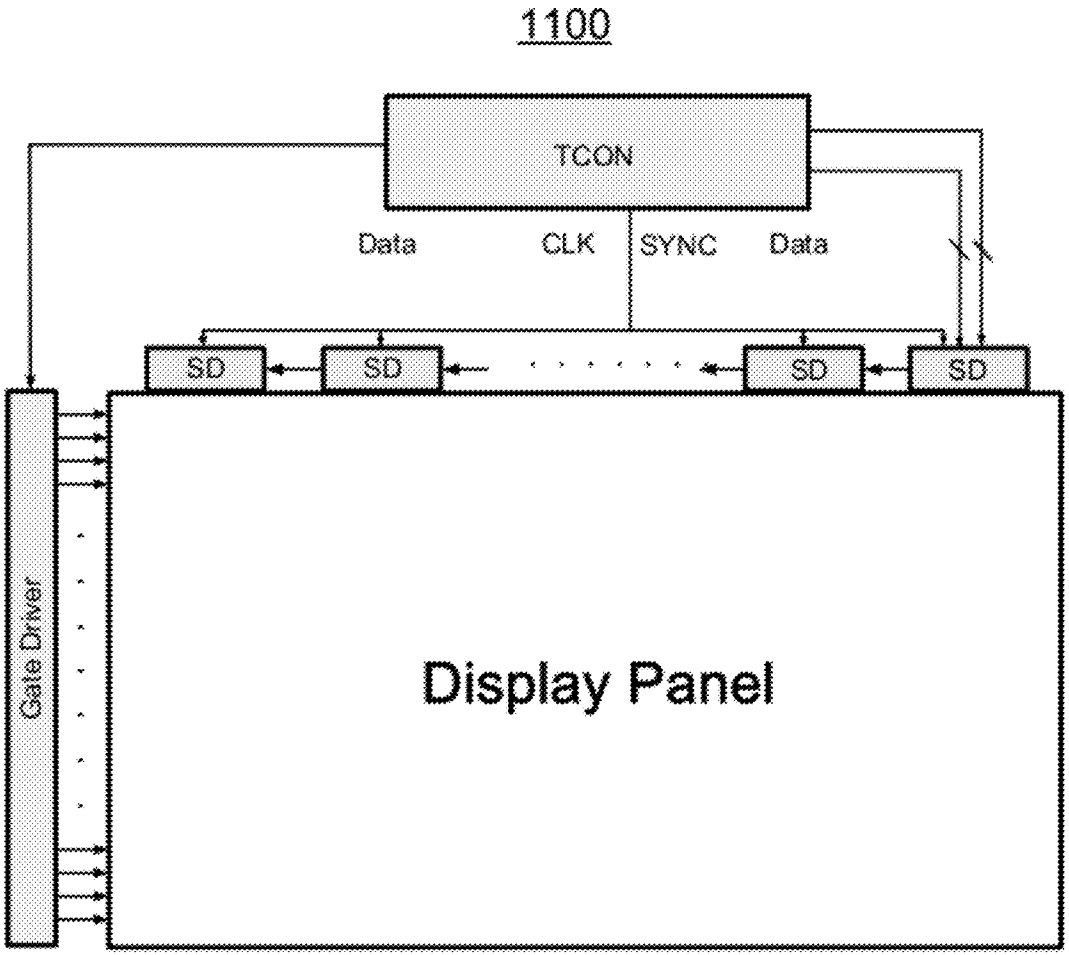
FIG. 11 shows schematically a block diagram of a display according to yet another embodiment of the present invention.

Referring to FIGS. 9-11, a display of the invention is shown according to three different embodiments 900, 1000 and 1100, where data different transmission interfaces are employed respectively. In the display 900, the synchronization signal SYNC and the at least one clock signal CLK are both transmitted from the timing controller TCON to the source drivers SD in the bus type manner. The data signals DATA are transmitted in the point-to-point type manner.

In the display 1000, the synchronization signal SYNC and the at least one clock signal CLK and the data signals DATA are all transmitted from the timing controller TCON to the source drivers SD in the bus type manner.

In the display 1100, the synchronization signal SYNC is transmitted from the timing controller TCON to the source drivers SD in the bus type manner, while the at least one clock signal CLK and the data signals DATA are both transmitted in the cascade type manner.

Figure 12:
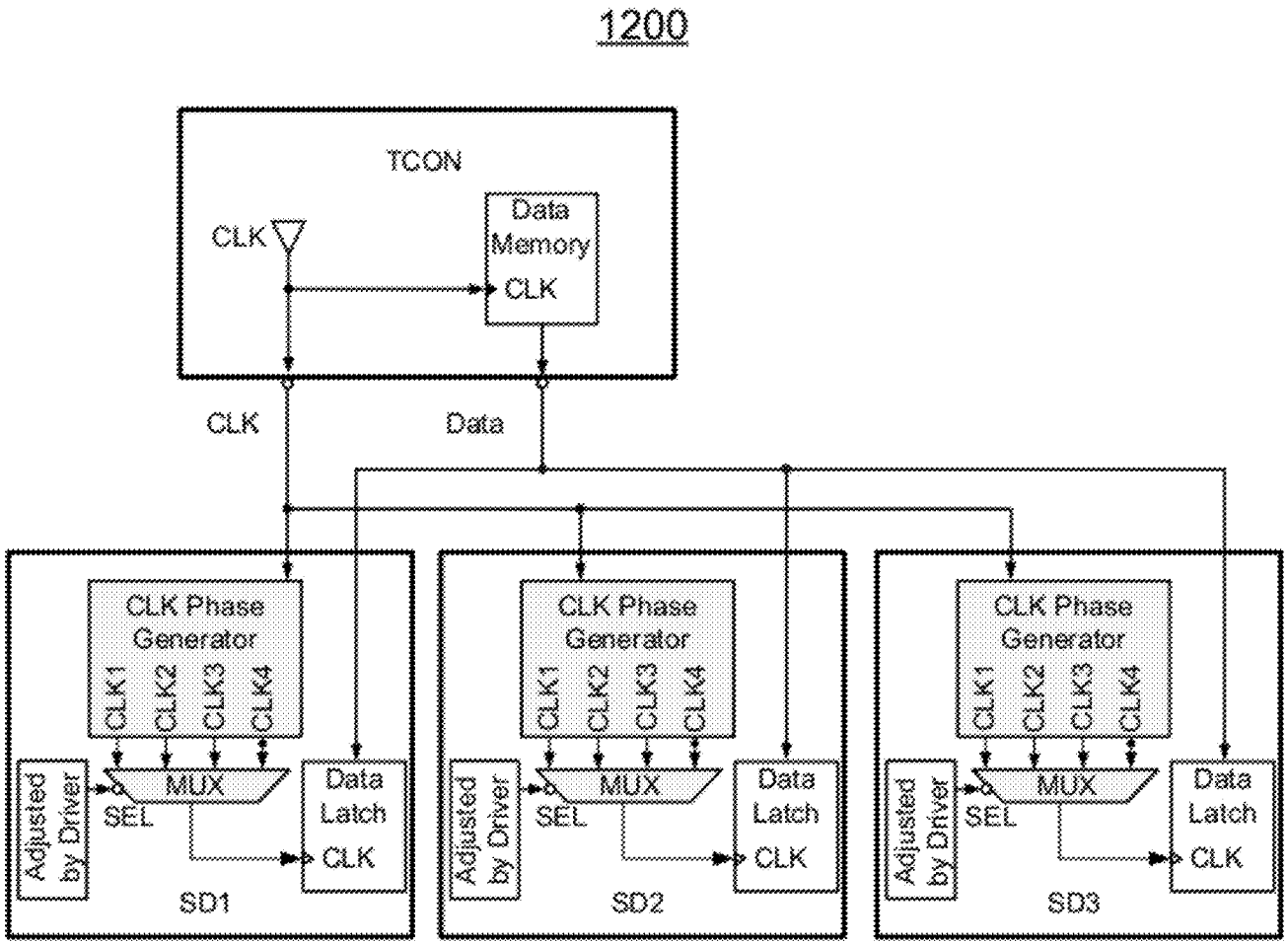
FIG. 12 shows schematically a partially block diagram of a display according to one embodiment of the present invention.
Figure 13:
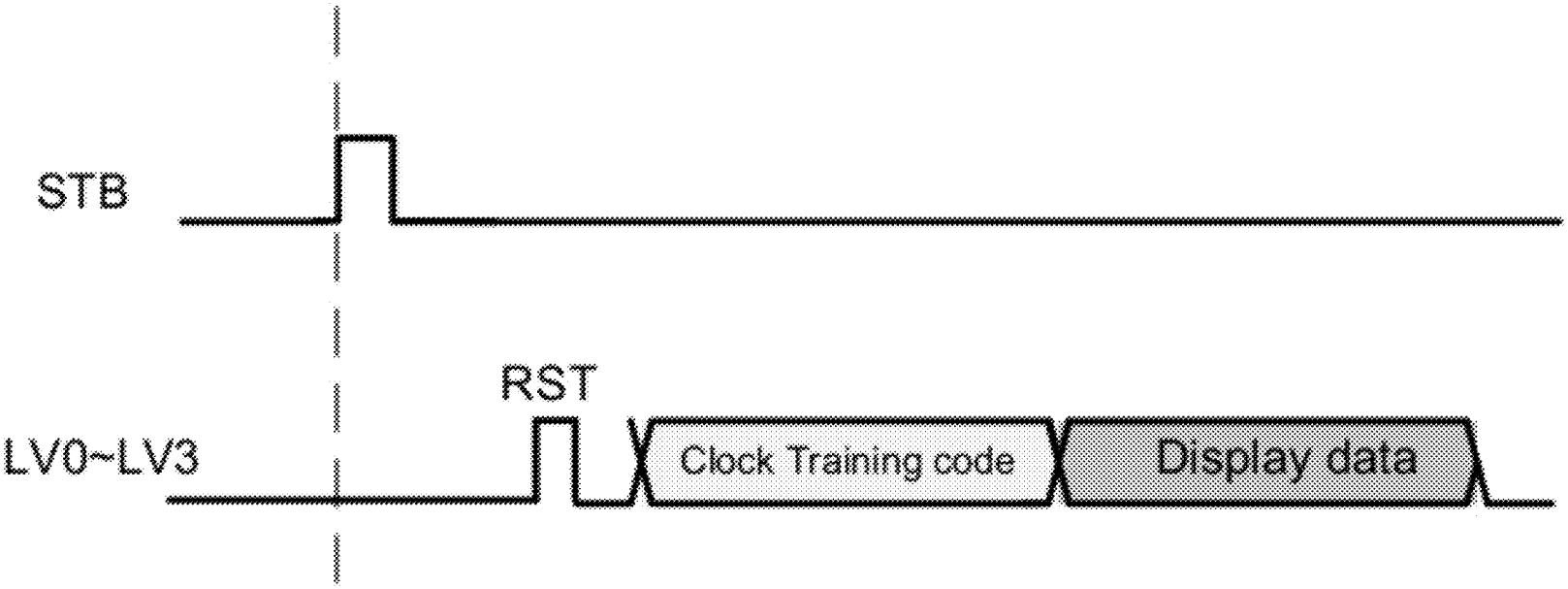
FIG. 13 shows schematically a timing chart of signals for driving a display according to one embodiment of the present invention.

FIG. 12 shows schematically a partially block diagram of a display 1200 according to one embodiment of the present invention. The display 1200 has essentially same structure as the display 100 shown in FIG. 1, except that the clock training and selection of the multi-phase clock signals generated by the multi-phase clock generator of the source driver are controlled by a receiving setup signal, DIO, or an output setup signal, STB, as shown in FIG. 13, rather than by a synchronization signal SYNC. Both the receiving setup signal DIO and the output setup signal STB are generated by the timing controller. The receiving setup signal DIO indicates the source drivers to prepare for data reception, while the output setup signal STB controls the time the source drivers output signals.

Figure 14:
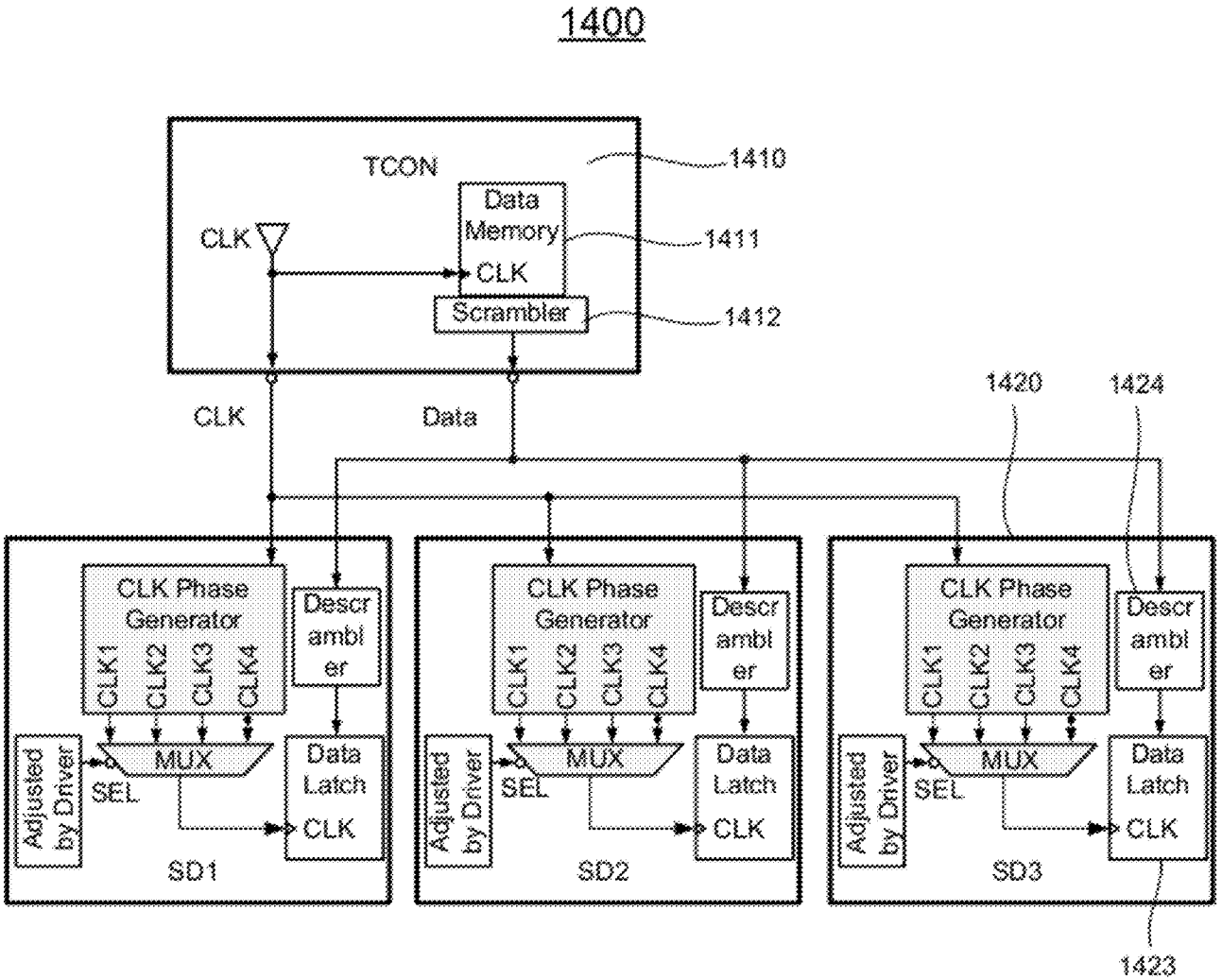
FIG. 14 shows schematically a partially block diagram of a display according to another embodiment of the present invention.

Usually, the clock training code is a set of highly regulated data, and thus strong electromagnetic interference (EMI) nay occur among them. One way to overcome the disadvantage is to employ the scrambler-descrambler principle to scramble the clock training code, so as to reduce the EMI. FIG. 14 shows schematically a partially block diagram of a display 1400 according to another embodiment of the present invention. The display 1400 has essentially similar structure to the display 100 shown in FIG. 1, except that scramblers and descramblers are utilized to reduce the EMI among the clock training code. As shown in FIG. 14, the display 1400 had a scrambler 1412 coupled with a data memory 1411 of the timing controller 141. The scrambler 1412 is adapted for scrambling the plurality of data signals and thus the clock training code, before they are transmitted to the source drivers 1420. The scrambled clock training code is used for selecting the optimal clock signal. However, the scrambled data signals need being restored/descrambled before they are sent to a display panel. This can be implemented by a plurality of descramblers 1424 with each coupled with the data latch unit 1423 of a corresponding source driver 1420 for descrambling scrambled data signals received from the scrambler 1412.

Figure 15:
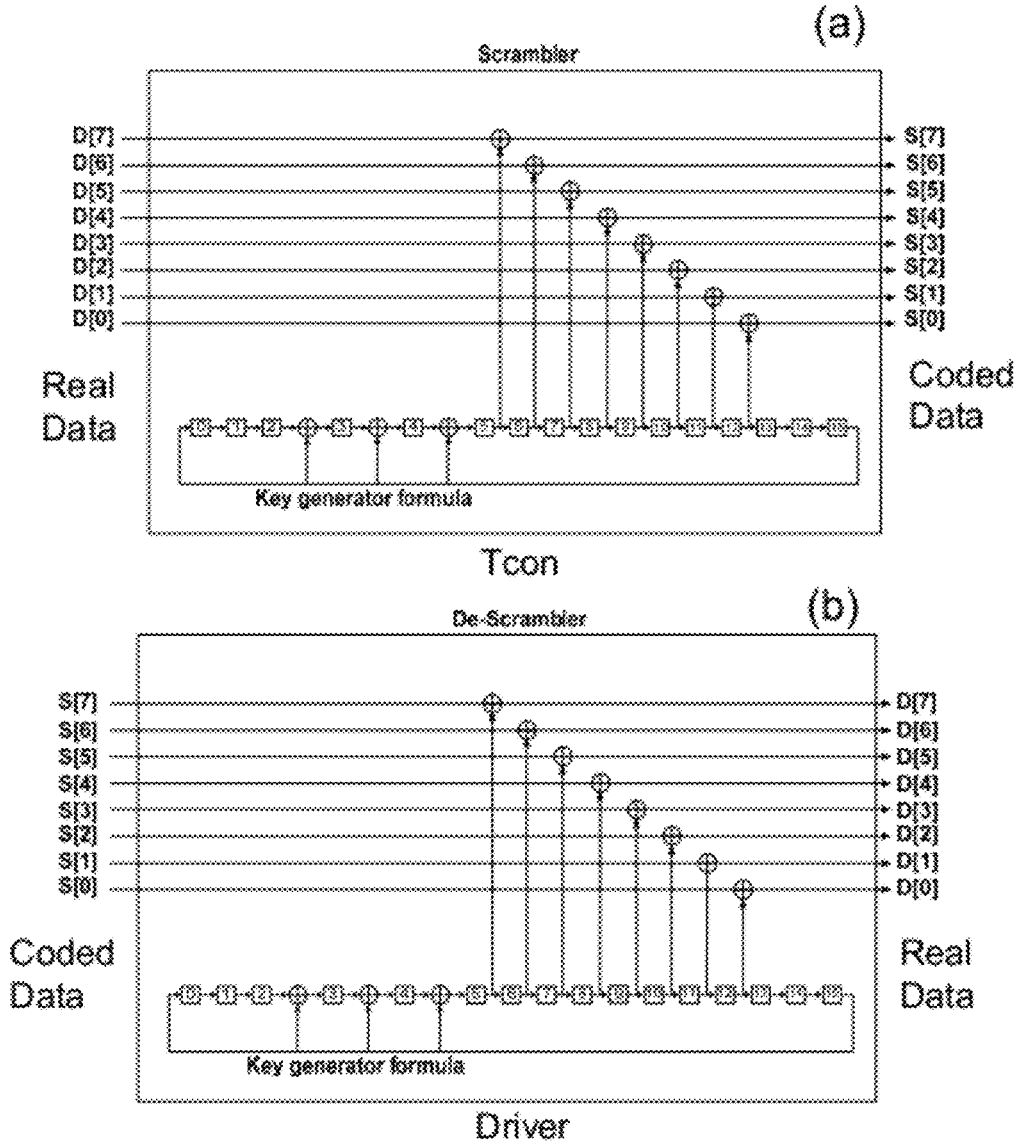
FIG. 15 shows schematically (a) scrambling and (b) descrambling of data according to one embodiment of the present invention.

FIG. 15 shows schematically (a) scrambling and (b) descrambling of data according to one embodiment of the present invention. Because the key generator may change the scrambler key, the timing controller TCON and the source driver are configured to change the key synchronously. For the timing controller TCON, the real data and the coded/scrambled data satisfies the relationship of:

$$(\text{real data})\oplus(\text{Key})=(\text{coded data}).$$

And for the source driver, the coded/scrambled data received from the timing controller TCON is descrambled as:

$$(\text{coded data})\oplus(\text{Key})=(\text{real data}).$$

Figure 16:
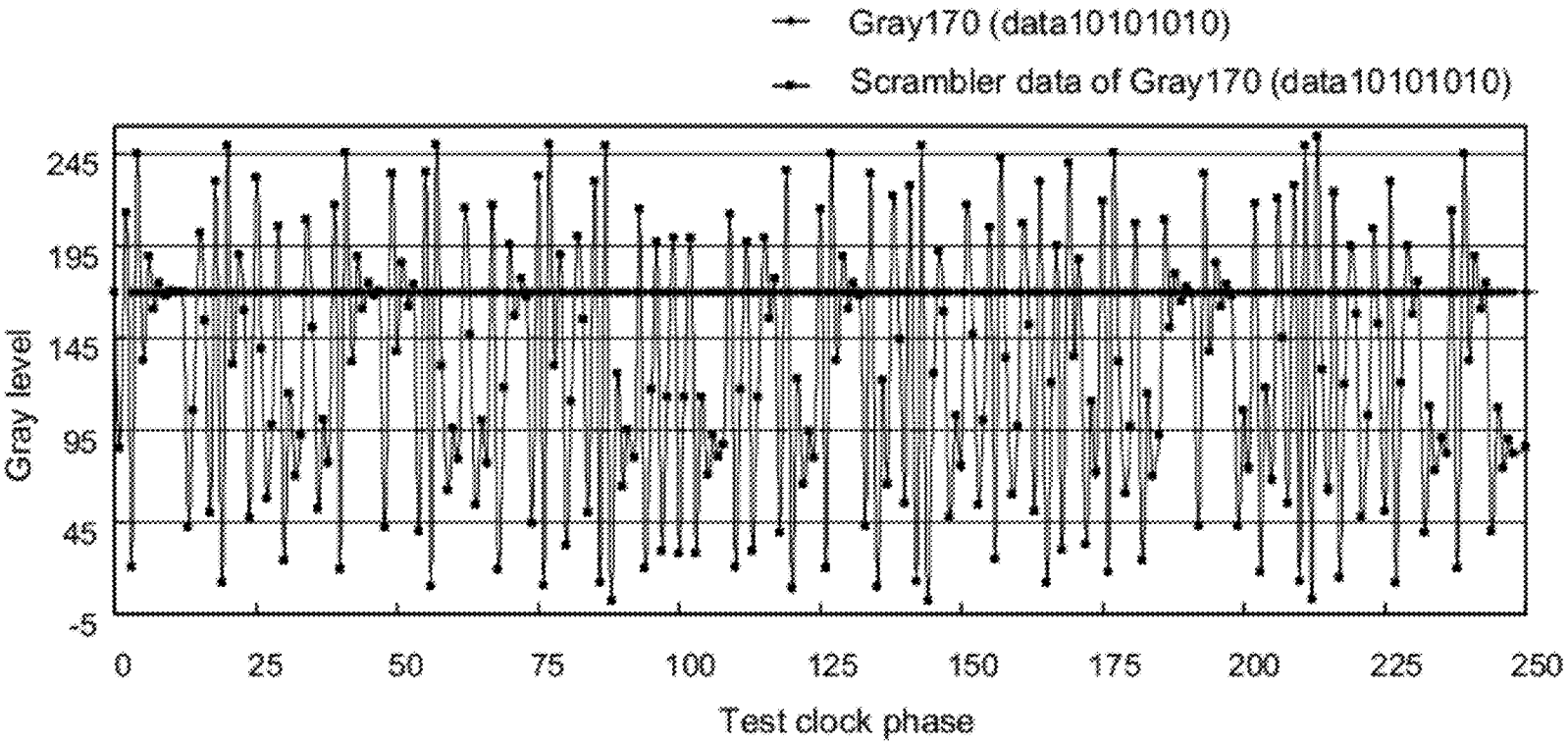
FIG. 16 shows schematically scrambled clock phase signals according to one embodiment of the present invention.

FIG. 16 shows scrambled clock phase signals of 250 phase data according to one embodiment of the present invention. After scrambled, the real data, 10101010 (greylevel 170), is no longer the regulated data 10101010, but irregulated data, thereby reducing the EMI.

Figure 17:
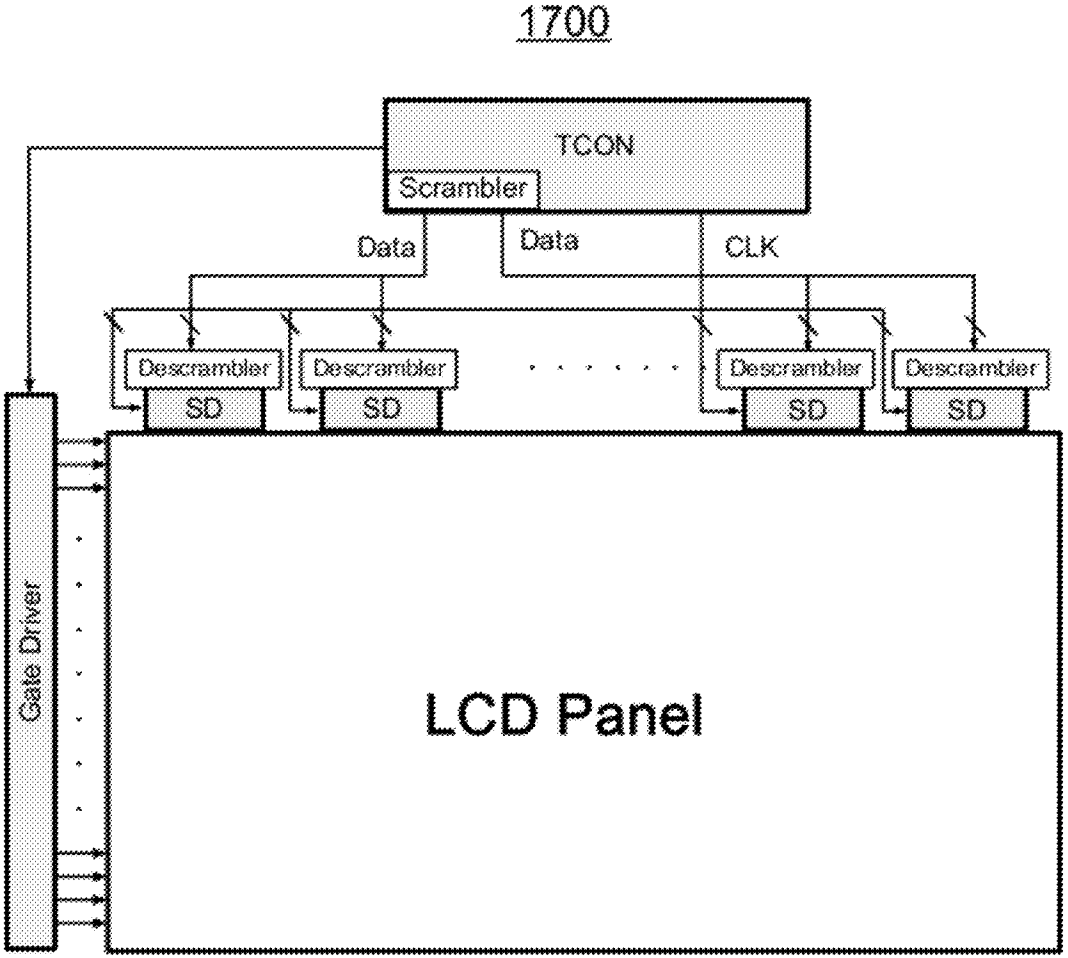
FIG. 17 shows schematically a block diagram of a display according to one embodiment of the present invention.
Figure 18:
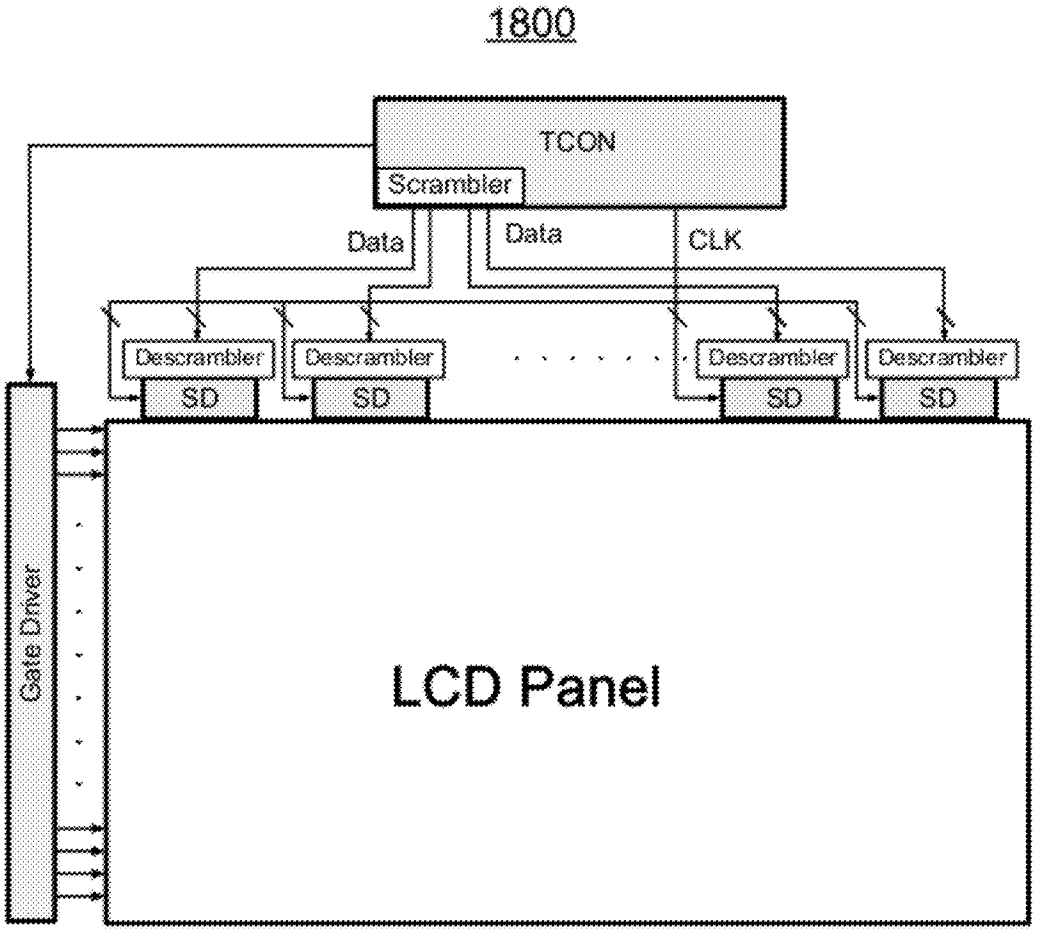
FIG. 18 shows schematically a block diagram of a display according to another embodiment of the present invention.

Referring to FIGS. 17 and 18, a display having scramblers and descramblers is shown according to three different embodiments 1700 and 1800, where data different transmission interfaces are employed respectively. In the display 1700, the data signals DATA and the at least one clock signal CLK are both transmitted from the timing controller TCON to the source drivers SD in the bus type manner. In the display 1800, the at least one clock signal CLK is transmitted from the timing controller TCON to the source drivers SD in the bus type manner, while the data signals DATA are transmitted in the point-to-point type manner.

One aspect of the present invention relates to a method for driving a display for data display. In one embodiment, the method includes the steps of (a) providing a plurality of data signals to be displayed, at least one clock signal, CLK, and a clock training code corresponding to the plurality of data signals; (b) generating a plurality of clock signals, {CLKj}, according to the at least one clock signal CLK, wherein j=1, 2, 3, . . . , N, N being a positive integer; (c) selecting one clock signal from the plurality of clock signals {CLKj} as an optimal clock signal according to the clock training code; and (d) latching the plurality of data signals according to the optimal clock signal. Each of the plurality of clock signals {CLKj} has a frequency that is identical to that of the at least one clock signal CLK and a phase that is different from each other and from that of the clock signals CLK. Step (a) is performed with a timing controller, and wherein steps (b)-(d) are performed with a plurality of source drivers. The clock training code is transmitted from the timing controller to the plurality of source drivers during a blanking.

In one embodiment, the selecting step comprises the steps of comparing each of the plurality of clock signals {CLKj} with the clock training code; determining whether a rising or falling edge of each of the plurality of clock signals {CLKj} falls within the clock training code; and selecting the one of which its rising edge or falling edge falls in the most middle of the clock training code as the optimal clock signal.

The method also includes the step of providing a synchronization signal, SYNC having a high voltage period defining a clock training period in which the clock training code occurs. In another embodiment, the method may have the step of providing a receiving setup signal, DIO, and/or an output setup signal, STB, used to define a clock training period in which the clock training code occurs.

Another aspect of the present invention relates to a display for displaying data. In one embodiment, the display has means for providing a plurality of data signals to be displayed, at least one clock signal, CLK, and a clock training code corresponding to the plurality of data signals; means for generating a plurality of clock signals, {CLKj}, according to the at least one clock signal CLK, wherein j=1, 2, 3, . . . , N, N being a positive integer; means for selecting one clock signal from the plurality of clock signals {CLKj} as an optimal clock signal according to the clock training code; and means for latching the plurality of data signals according to the optimal clock signal; and means for displaying the latched data signals.

In one embodiment, the providing means comprises a timing controller. The generating means comprises a multi-phase clock generator, and wherein the selecting means comprises a clock selector. The multi-phase clock generator and the clock selector constitute a source driver.

In brief, the present invention, among other things, recites a display that utilizes a CLK phase auto-adjusting mechanism in source drivers to increase the operation frequency of the display and improve the performance of the display and a method of driving same. Accordingly, there is no need to increase the frequency of the at least one clock signal CLK, and therefore the integrity of the at least one clock signal CLK is reserved during operation. Additionally, the use of the rising edge of a clock signal to latch the data signal causes no issue of the internal duty. Further, no data skew occurs according to the invention.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A display for displaying data, comprising:

(a) a timing controller (TCON) configured to provide a plurality of data signals to be displayed, at least one clock signal, CLK, and a clock training code corresponding to the plurality of data signals;

(b) a plurality of source drivers coupled with the timing controller, each source driver (SD) configured to receive one or more corresponding data signals, the at least one clock signal CLK and the clock training code from the timing controller, generate a plurality of clock signals, {CLKj}, according to the at least one clock signal CLK, wherein j=1, 2, 3, . . . , N, N being a positive integer, select one clock signal from the plurality of clock signals {CLKj} as an optimal clock signal according to the clock training code, and latch the one or more corresponding data signals according to the optimal clock signal; and (c) a display panel coupled with the plurality of source drivers, and configured to display the plurality of latched data received from the plurality of source drivers.

2. The display of claim 1, wherein each source driver comprises:

(a) a multi-phase clock generator for generating the plurality of clock signals, {CLKj}; and (b) a clock selector for obtaining the optimal clock signal from the plurality of clock signals {CLKj} according to the clock training code.

3. The display of claim 2, wherein the multi-phase clock generator comprises buffer delays, delay locked loops (DLL) or phase locked loops (PLL).

4. The display of claim 3, wherein each of the plurality of clock signals {CLKj} has a frequency that is identical to that of the at least one clock signal CLK, and a phase that is different from each other and from that of the at least one clock signal CLK.

5. The display of claim 1, wherein the clock training code is transmitted from the timing controller to the plurality of source drivers during a blanking.

6. The display of claim 5, wherein the timing controller is configured to further provide a synchronization signal, SYNC, to the plurality of source drivers, wherein the synchronization signal SYNC has a period defining a clock training period in which the clock training code occurs.

7. The display of claim 5, wherein the timing controller is configured to further provide a receiving setup signal, DIO, and/or an output setup signal, STB, used to define a clock training period in which the clock training code occurs.

8. The display of claim 1, wherein the clock signal is transmitted from the timing controller to the plurality of source drivers in a bus type, and wherein the plurality of data signals is transmitted from the timing controller to the plurality of source drivers in one of a bus type, a point-to-point type and a cascade type.

9. The display of claim 1, further comprising (a) a scrambler coupled with the timing controller for scrambling the plurality of data signals before it is provided to the plurality of source drivers; and (b) a plurality of descramblers, each descramble coupled with a corresponding source driver for descrambling scrambled data signals received from the scrambler.

10. A method for driving a display for data display, comprising the steps of:

(a) providing a plurality of data signals to be displayed, at least one clock signal, CLK, and a clock training code corresponding to the plurality of data signals;

(b) generating a plurality of clock signals, {CLKj}, according to the at least one clock signal CLK, wherein j=1, 2, 3, . . . , N, N being a positive integer;

(c) selecting one clock signal from the plurality of clock signals {CLKj} as an optimal clock signal according to the clock training code; and (d) latching the plurality of data signals according to the optimal clock signal.

11. The method of claim 10, wherein step (a) is performed with a timing controller, and wherein steps (b)-(d) are performed with a plurality of source drivers.

12. The method of claim 11, wherein the generating step is performed with a multi-phase clock generator.

13. The method of claim 12, wherein the multi-phase clock generator comprises buffer delays, delay locked loops (DLL) or phase locked loops (PLL).

14. The method of claim 13, wherein each of the plurality of clock signals {CLKj} has a frequency that is identical to that of the at least one clock signal CLK, and a phase that is different from each other and from that of the at least one clock signal CLK.

15. The method of claim 14, wherein the selecting step comprises the steps of:

(a) comparing each of the plurality of clock signals {CLKj} with the clock training code;

(b) determining whether a rising or falling edge of each of the plurality of clock signals {CLKj} falls within the clock training code; and (c) selecting the one of which its rising edge or falling edge falls in the most middle of the clock training code as the optimal clock signal.

16. The method of claim 15, wherein the selecting step is performed with a clock selector.

17. The method of claim 11, wherein the clock signal is transmitted from the timing controller to the plurality of source drivers in a bus type, and wherein the plurality of data signals is transmitted from the timing controller to the plurality of source drivers in one of a bus type, a point-to-point type and a cascade type.

18. The method of claim 11, wherein the clock training code is transmitted from the timing controller to the plurality of source drivers during a blanking.

19. The method of claim 10, further comprising the step of providing a synchronization signal, SYNC having a high voltage period defining a clock training period in which the clock training code occurs.

20. The method of claim 10, further comprising the step of providing a receiving setup signal, DIO, and/or an output setup signal, STB, used to define a clock training period in which the clock training code occurs.

21. The method of claim 10, further comprising the step of displaying the latched data signals.

22. A display for displaying data, comprising:

(a) means for providing a plurality of data signals to be displayed, at least one clock signal, CLK, and a clock training code corresponding to the plurality of data signals;

(b) means for generating a plurality of clock signals, {CLKj}, according to the at least one clock signal CLK, wherein j=1, 2, 3, . . . , N, N being a positive integer;

(c) means for selecting one clock signal from the plurality of clock signals {CLKj} as an optimal clock signal according to the clock training code; and (d) means for latching the plurality of data signals according to the optimal clock signal; and (e) means for displaying the latched data signals.

23. The display of claim 22, wherein the providing means comprises a timing controller.

24. The display of claim 22, wherein the generating means comprises a multi-phase clock generator, and wherein the selecting means comprises a clock selector.

25. The display of claim 24, wherein the multi-phase clock generator and the clock selector constitute a source driver.

* * * * *